US005862813A

United States Patent [19]

Bugane

[11] Patent Number: 5,862,813

[45] Date of Patent: Jan. 26, 1999

[54] HEATABLE HAIR CURLER CAPABLE OF RELEASING HEAT SLOWLY

[76] Inventor: Primo Bugane, Via Modena, 23, 10091 Alpignano To, Italy

[21] Appl. No.: 851,909

[22] Filed: May 6, 1997

[30] Foreign Application Priority Data

May 7, 1996 [IT] Italy ..... TO960102 U

[51] Int. Cl.[6] ..... A45D 6/16

[52] U.S. Cl. ..... 132/252; 132/248; 132/250; 132/268; 34/95

[58] Field of Search ..... 132/233, 220, 132/222, 251, 252, 268, 226, 228, 211, 227, 221; 34/90, 91, 98, 95, 96, 124, 350; 219/222, 225, 241, 505, 521, 401

[56] References Cited

U.S. PATENT DOCUMENTS 2,847,015 8/1958 Davis .

5,309,928 5/1994 Longoria .

FOREIGN PATENT DOCUMENTS

| | | |
|---|---|---|
| 798214 | 5/1936 | France . |
| 2 565 797 | 12/1985 | France . |
| 77 33 493 | 12/1978 | Germany . |
| 28 36 196 | 10/1979 | Germany . |
| 141377 | 8/1921 | United Kingdom . |
| 2 060 372 | 5/1981 | United Kingdom . |
| 2160418 | 12/1985 | United Kingdom . |

*Primary Examiner*—Cary E. O'Connor
*Assistant Examiner*—Pedro Philogene

[57] ABSTRACT

A hair curler constituted by a full body (10) of cylindrical shape and a net member (11) removably applicable to said body (10). At least the cylindrical body is made of a material capable of being heated by immersing same in a hot liquid and of slowly releasing the heat to a lock of hair (14) to which the hair curler is applied. On the cylindrical body (10) there is formed a protuberance (13) helically extending throughout the whole length of the cylindrical body (10).

3 Claims, 1 Drawing Sheet

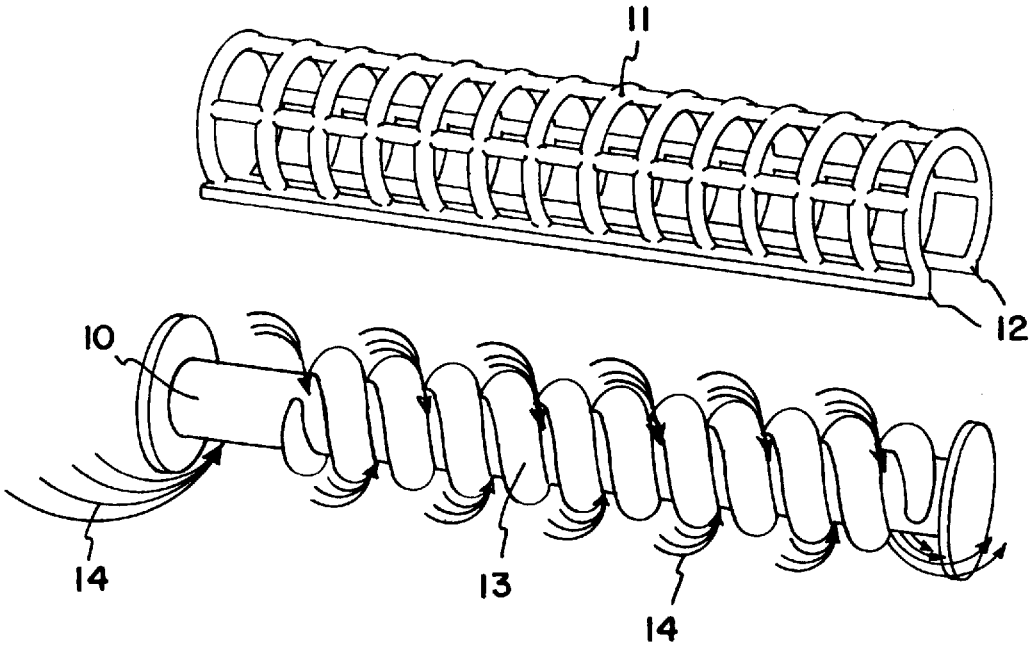
11
12
10
14
13
14

HEATABLE HAIR CURLER CAPABLE OF RELEASING HEAT SLOWLY

FIELD OF THE INVENTION

The present invention relates to a heatable hair curler capable of releasing heat slowly.

BACKGROUND OF THE INVENTION

At present there are commercially available hair curlers that are heated by slipping them onto special appendixes of apparatuses fitted with electric resistors. In some other cases, such apparatuses contain a liquid that is heated up when the hair curler is introduced in a heat source.

Commercially available hair curlers of the aforesaid and still other kinds have the task of releasing heat slowly to the hair that is wound thereupon in such manner as to give a hair-set without having to use an electric hair dryer.

Italian Utility Model No. 0 197 245 discloses a type of the above discussed hair curlers, consisting of a full body of cylindrical shape on which a net is applied after winding it on a lock of hair so as to hold it firmly. According to this disclosure, the cylindrical body of the hair curlers made of a material such that the hair curler can simply be immersed in hot water to gain heat quickly and then release it later in a sufficiently elongated period of time once it is positioned on the lock of hair, thereby attaining the desired hair-set. The main advantages of such a hair curler are its simple construction and extremely easy use, as it does not require the utilisation of electric appliances to be heated up, nor does it need to be filled with heating liquids or other materials. However, this prior art hair curler has turned out to be scarcely efficient in creating curls of hair, as the hair comes out simply undulated, without long-lasting curls. To attain curls, it is necessary to wind the locks of hair in helical manner on the hair curler and not simply in circles as disclosed in Italian Utility Model No. 0 197 245.

SUMMARY OF THE INVENTION

It is an object of the present invention to provide a hair curler constituted by a full body of substantially cylindrical shape and a net member removably applicable to said body, wherein at least said cylindrical body is made of a material capable of being heated by immersing same in a hot liquid and slowly releasing the heat to a lock of hair to which the hair curler is applied, characterised in that on said cylindrical body there is formed a protuberance helically extending substantially throughout the whole length of said cylindrical body.

BRIEF DESCRIPTION OF THE DRAWINGS

The hair curler according to the present invention will now be described, reference being made to the accompanying drawing which is an exploded view of the proposed hair curler.

DETAILED DESCRIPTION OF THE PREFERRED EMBODIMENT

The hair curler in accordance with the present invention is simply composed of a full cylindrical body 10, advantageously made of plastic material, particularly low density polyethylene.

On the peripheral part of the hair curler there is formed a protuberance 13 helically extending almost throughout the whole length of said body and defining a helical channel thereon.

Consequently, also the flat surface of the hair curler takes a helical shape. It is on this helical flat surface that the lock of hair 14 is to be wound. In this way, instead of being wound in circles as in prior art hair curlers (see e.g. Italian Utility Model No. 197 245), the lock of hair is disposed according to a helical pattern.

A net member 11 of plastic material is then snap-fitted onto cylindrical body 10. The plastic net member 11 is elastically yieldable so as to divaricate sufficiently at its opening 12 which is narrower than the cross-sectional area of the helical protuberance 13 of body 10. Owing to this arrangement, the two elements can only be disengaged manually once they are applied to the lock of hair.

The plastic material, particularly the low-density polyethylene, is such that when the hair curler, either the body 10 and/or the net member 11, is immersed in hot water, it will heat up and retain the heat for a long time, releasing it slowly to the lock of hair wound upon the hair curler, whereby the lock of hair will take the desired set.

Moreover, the hair-set will take the shape of curls owing to the fact that the locks of hair have been wound on the body of the hair curler according to a helical pattern.

Advantageously, the complete hair curler will be immersed in water boiling for at least three minutes. During this period, the hair curler will take in the maximum amount of heat it is capable of absorbing, in order to release that heat to the lock of hair slowly later on, being therefore active for several minutes.

If the hair curler is applied hot and wet, it produces a sufficient amount of steam. This steam is very important when hair is treated, particularly with long hair, which is known to be often of fragile constitution. The steam revives the hair and helps it in acquiring brightness, softness and volume.

Furthermore, steam prevents dry hair from breaking and is helpful in removing grease from greasy hair.

It has been found that the length of the helical channel should preferably be twice that of the cylindrical body 10. In this way, a lock of hair 14 of considerable length can be wound without overlapping.

The spiral-wound lock of hair 14 will receive heat from both the body 10 and the protuberance 13, with evident advantages in comparison with prior art hair curlers wherein heat is transferred only from the cylindrical body on which the hair is wound in overlapping circles.

In a few minutes, e.g. about five, the lock of hair 14 will have reached the desired set with uniform curls such as those attainable by a permanent wave, but without the use of acids and chemicals noxious to the health and the environment.

I claim:

1. A heatable hair curler constituted by a full body (10) of substantially cylindrical shape and a net member (11) removably applicable to said body (10) such that when applied, the net member and the cylindrical body can only be disengaged manually, wherein at least said cylindrical body is made of low-density polyethylene capable of being heated by immersing the same in a hot liquid and slowly releasing heat to a lock of hair (14) to which the hair curler is applied, and wherein on said cylindrical body (10) there is formed a helical protuberance (13) extending substantially throughout a whole length of said cylindrical body (10), wherein said helical protuberance (13) determines a helical channel on said cylindrical body (10), said helical channel extending substantially throughout the whole length of said cylindrical body (10).

2. A heatable hair curler as claimed in claim 1, wherein said helical protuberance (13) is formed as a unit with said cylindrical body (10).

3. A heatable hair curler as claimed in claim 1, wherein a width of said helical channel is substantially equal to a width of said helical protuberance (13).

* * * * *